US011000934B2

(12) United States Patent
Esenwein

(10) Patent No.: US 11,000,934 B2
(45) Date of Patent: May 11, 2021

(54) HAND POWER TOOL HAVING AN ELECTRONICALLY COMMUTATED ELECTRIC MOTOR

(71) Applicant: Robert Bosch GmbH, Stuttgart (DE)

(72) Inventor: Florian Esenwein, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 121 days.

(21) Appl. No.: 16/276,416

(22) Filed: Feb. 14, 2019

(65) Prior Publication Data

US 2019/0176289 A1 Jun. 13, 2019

Related U.S. Application Data

(62) Division of application No. 14/615,132, filed on Feb. 5, 2015, now Pat. No. 10,226,850.

(30) Foreign Application Priority Data

Feb. 6, 2014 (DE) ..... 10 2014 202 218.5

(51) Int. Cl.

| | |
|---|---|
| ***B24B 23/04*** | (2006.01) |
| ***B24B 47/00*** | (2006.01) |
| ***B25F 5/00*** | (2006.01) |
| ***B25F 5/02*** | (2006.01) |

(52) U.S. Cl.

CPC ..... *B24B 23/04* (2013.01); *B24B 47/00* (2013.01); *B25F 5/00* (2013.01); *B25F 5/02* (2013.01)

(58) Field of Classification Search

None

See application file for complete search history.

(56) References Cited

U.S. PATENT DOCUMENTS

| | | | | |
|---|---|---|---|---|
| 5,868,208 | A * | 2/1999 | Peisert | B23D 29/005 173/110 |
| 8,152,601 | B2 | 4/2012 | Zaiser | |
| 8,272,452 | B2 | 9/2012 | Katou | |
| 8,480,453 | B2 | 7/2013 | Kobayashi | |
| 2005/0270754 | A1 | 12/2005 | Roehm | |
| 2007/0131439 | A1 | 6/2007 | Hashimoto | |
| 2009/0160373 | A1 * | 6/2009 | Katou | B25F 5/02 318/286 |

(Continued)

FOREIGN PATENT DOCUMENTS

| | | | |
|---|---|---|---|
| CN | 1803397 | A | 7/2006 |
| CN | 101415527 | A | 4/2009 |

(Continued)

*Primary Examiner* — Hemant Desai
*Assistant Examiner* — Tanzim Imam
(74) *Attorney, Agent, or Firm* — Maginot, Moore & Beck LLP

(57) ABSTRACT

A hand power tool includes at least one electric-motor drive that is configured to act upon at least one motor shaft, and that is accommodated by a first housing part, the motor shaft and the first housing part defining a first common axis. The electric-motor drive is an electronically commutated electric motor. The hand power tool further includes at least one output shaft configured to drive a tool in an oscillating manner, and at least one second housing part that is configured to accommodate a rechargeable battery, the rechargeable battery and the second housing part defining a second common axis.

13 Claims, 6 Drawing Sheets

(56) References Cited

U.S. PATENT DOCUMENTS

2009/0308213 A1* 12/2009 Zaiser ..... F16D 1/101
81/488
2010/0003906 A1* 1/2010 Zaiser ..... B24B 23/04
451/357
2010/0105287 A1 4/2010 Nordtrom
2010/0186980 A1* 7/2010 Heilig ..... B25F 5/006
173/217
2011/0081847 A1 4/2011 Yang
2012/0037391 A1* 2/2012 Clabunde ..... B24B 41/007
173/162.1
2012/0165152 A1* 6/2012 Tokunaga ..... B25B 21/00
475/159
2012/0187782 A1 7/2012 Esenwein
2013/0037290 A1* 2/2013 Clabunde ..... B25F 5/006
173/162.1
2013/0220659 A1 8/2013 Itakura et al.
2014/0020918 A1* 1/2014 Klabunde ..... B23Q 5/027
173/49
2014/0123785 A1* 5/2014 Sumi ..... B27B 19/006
74/45
2015/0041170 A1* 2/2015 Yoshikane ..... B25D 11/00
173/104

FOREIGN PATENT DOCUMENTS

CN 102029564 A 4/2011
DE 10 2007 018 464 A1 10/2008
DE 10 2010 007 714 B3 6/2011
DE 10 2010 027 205 A1 1/2012
DE 10 2010 039 152 A1 2/2012
DE 10 2011 015 117 A1 9/2012
EP 2 213 417 A2 8/2010
WO 02/081153 A1 10/2002
WO 2009/029970 A1 3/2009
WO 2013/046541 A1 4/2013

* cited by examiner

HAND POWER TOOL HAVING AN ELECTRONICALLY COMMUTATED ELECTRIC MOTOR

This application is a divisional of U.S. patent application Ser. No. 14/615,132, filed on Feb. 5, 2015, which claims priority under 35 U.S.C. § 119 to patent application no. DE 10 2014 202 218.5, filed on Feb. 6, 2014 in Germany, the disclosures of each of which are incorporated herein by reference in their entirety.

The disclosure relates to a hand power tool having an electronically commutated electric motor.

BACKGROUND

Known from DE 10 2007 018 464 A1 is a power tool, driven by an electric motor, which has a drive shaft, and which has a tool shaft on which the tool is accommodated. The rotary motion of the drive shaft is transmitted to the tool shaft via a coupling means. The drive shaft in this case is rotatably accommodated in rotary bearings in the housing of the power tool, the coupling means engaging on the drive shaft in the portion between the two rotary bearings.

SUMMARY

The hand power tool according to the disclosure has the advantage, as compared with the prior art, of being particularly powerful, efficient and low-maintenance. This is achieved in that at least one electric-motor drive acting upon a motor shaft is realized as an electronically commutated electric motor. Electronically commutated electric motors are distinguished by a high efficiency with an absence of wear. Advantageously, the electronically commutated electric motor is accommodated by a first housing part. The motor shaft and the first housing part define a first common axis. Advantageously, a second housing part is provided to accommodate a rechargeable battery, wherein the rechargeable battery and the second housing part define a second common axis.

Advantageous developments of the hand power tool are rendered possible by the features specified in the detailed description, the claims, and the drawings.

Advantageously, the first axis is at an angle a in relation to the second axis, the angle being approximately 90°. From an ergonomic viewpoint, this makes the hand power tool easy to handle.

An output shaft carries the tool. Advantageously, the motor shaft and the output shaft are disposed parallelwise in relation to each other. This provides for a compact structural design. However, the motor shaft and the output shaft may also be disposed at an angle in relation to each other, the angle being between −30 and 30°, particularly between −10 and 10°, but preferably between −3.0 and 3.0°.

In a particularly advantageous embodiment, the electronically commutated electric motor has a diameter $d_1$, which is between 25 and 60 mm, particularly between 32 and 55 mm, but preferably between 37 and 51 mm. The use of a powerful electric-motor drive makes it possible to achieve an electric-motor drive that is highly efficient, while at the same time the hand power tool is of a compact structural design.

Advantageously, at least one coupling/connecting element is provided to convert a rotary motion of the motor shaft into a swivel motion of the output shaft.

Advantageously, the oscillating reciprocating motion is in an angular range of between 0.4 and 2.5°, particularly between 0.8 and 1.6°, but preferably between 1 and 1.4°. Up to 30000 reciprocating motions are executed per second, but particularly 25000 reciprocating motions per second, but preferably up to 20000 reciprocating motions per second.

It is proposed that the coupling/connecting element have at least one coupling member, which is realized as a closed coupling member. A particularly robust transmission of motion, from the motor shaft to the output shaft, is thereby ensured.

Advantageously, at least one first bearing and one second bearing are provided to accommodate the motor shaft in a rotatable manner. A third bearing and a fourth bearing are provided to accommodate the output shaft in a rotatable manner. This embodiment has the advantage that the shafts are very stiffly mounted in the first housing part of the hand power tool, and the forces acting upon the shafts can be directed into the first housing part.

Furthermore, it is proposed according to the disclosure that a bearing element be provided to connect the first bearing and the third bearing, in particular to each other, and thereby to ensure high stability of the bearing system.

Furthermore, it is proposed that the bearing element be realized as a separate component in respect of the first housing.

Further advantageous and expedient embodiments are given by the description of the figures and by the drawings.

BRIEF DESCRIPTION OF THE DRAWINGS

Exemplary embodiments of a hand power tool according to the disclosure and of a coupling/connecting element are shown in the drawings.

In the drawings.

DETAILED DESCRIPTION

Figure 1:
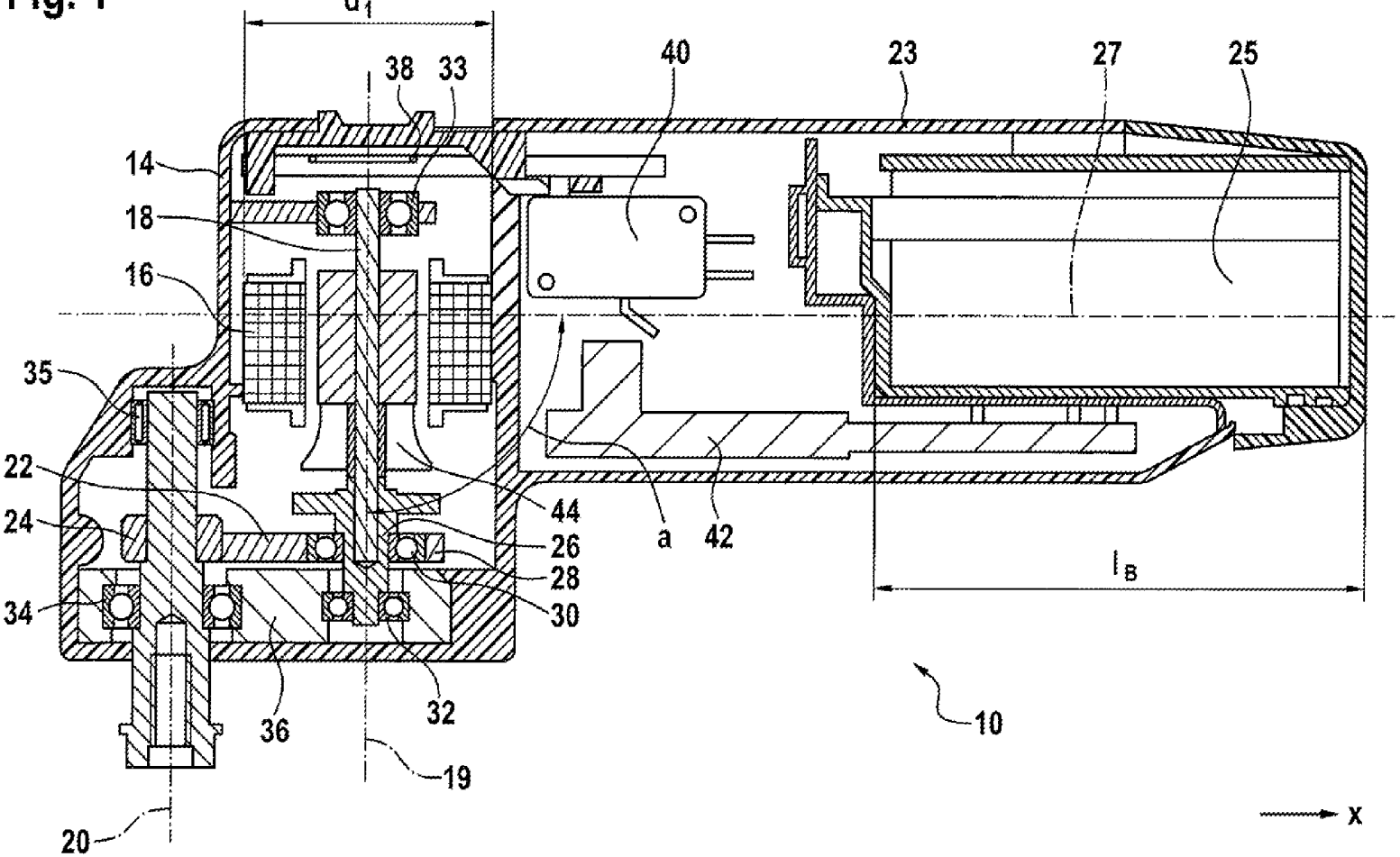
FIG. 1 shows a partial view of the hand power tool according to the disclosure, in a schematic representation.

FIG. 1 shows a hand power tool 10. An electric-motor drive 16, which drives a motor shaft 18, is disposed in a first housing part 14. An output shaft 20 carries a tool, not represented in greater detail, that is to be driven in an oscillating manner. The motor shaft 18 and the first housing part define a first common axis 19, which is coaxial with the motor shaft 18. A second housing part 23 adjoins the first housing part 14. The first housing part 14 and the second housing part 23 may be realized as one piece or as separate component units.

The second housing part 23 serves as a handle for a user of the hand power tool 10, or is realized as a handle. The term "handle" is to be understood to mean a component around which an operator's hand can be placed, at least partially, in order to guide the hand power tool 10.

The second housing part 23 is provided for the insertion of a rechargeable battery 25. Together with the rechargeable battery, the second housing part 23 defines a second axis 27, which is coaxial with the direction of insertion of the rechargeable battery 25.

In the exemplary embodiment, the electric-motor drive 16 is realized as an electronically commutated electric motor 16. Electric motors of this type may be realized as internal-rotor motors or external-rotor motors. In the exemplary embodiment in FIG. 1, the electronically commutated electric motor 16 is an internal-rotor motor.

As can be seen in FIG. 1, the first axis 19 is at an angle a in relation to the second axis 27, the angle being approximately 90°. The angle specification does not take account of any possible tolerances in the angle specification.

The motor shaft 18 and the output shaft 20 are disposed parallelwise in relation to each other. However, the motor shaft 18 and the output shaft 20 may also be disposed at an angle in relation to each other, the angle being between −30 and 30°, particularly between −10 and 10°, but preferably between −3.0 and 3.0°. The angle specification does not take account of any possible tolerances in the angle specification.

In the embodiment according to the disclosure, the electronically commutated electric motor 16 has a diameter $d_1$, which is between 25 and 60 mm, particularly between 32 and 55 mm, but preferably between 37 and 51 mm.

The rotary motion of the motor shaft 18 is transmitted to the output shaft 20 via a coupling/connecting element 22. The coupling/connecting element 22 is disposed between the motor shaft 18 and the output shaft 20. By means of the coupling/connecting element 22, the rotating motion of the motor shaft 18 is converted into an oscillating reciprocating motion of the output shaft 20.

Figure 2:
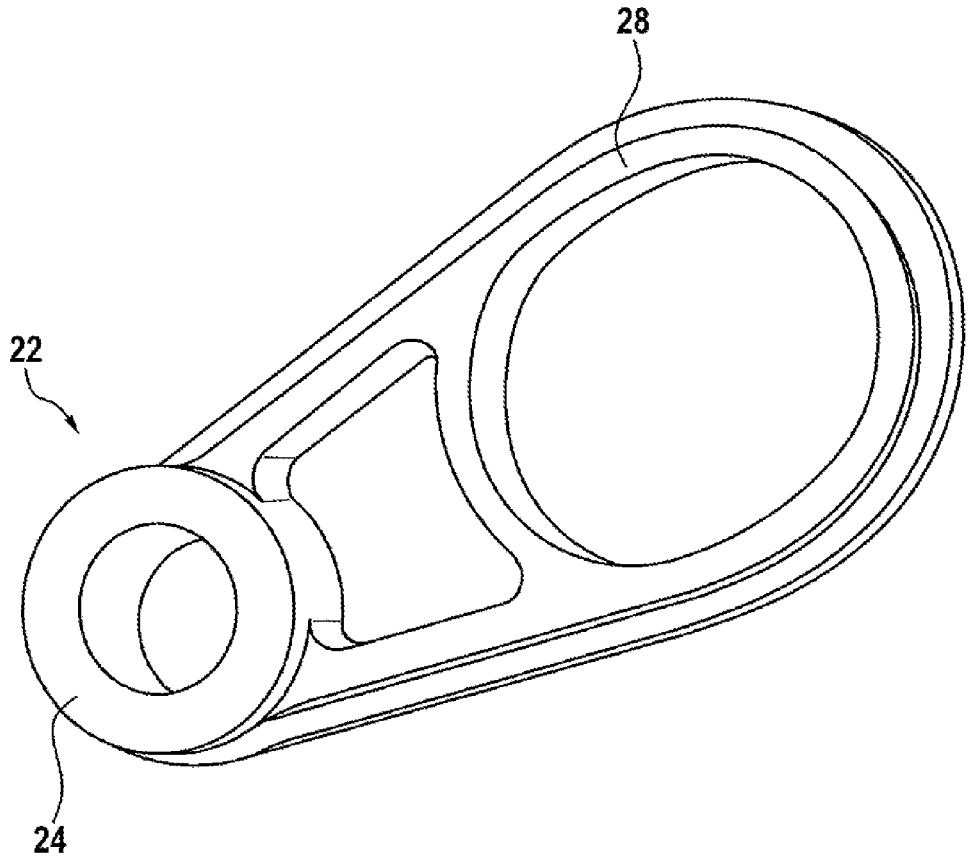
FIG. 2 shows a coupling/connecting element, in a detail view.

In the embodiment according to the disclosure, the coupling/connecting element 22 has a connecting member 24, which is connected to the output shaft 20 in a rotationally fixed manner. An eccentric element 26 is connected to the motor shaft 18 in a rotationally fixed manner. The eccentric element 26 may be integrally connected to the motor shaft 18. The coupling/connecting element 22 additionally has a coupling member 28. In particular, the coupling member 28 is realized in a closed manner. A ball bearing 30 is disposed between the eccentric element 26 and the coupling member 28. The coupling member 28 surrounds the ball bearing 30, at least partially. It is also conceivable, however, for the coupling member 28 to surround the eccentric element 26, at least partially. The motion of the eccentric element 26, which is eccentric relative to the first rotation axis 19 of the motor shaft 18, is taken up by the coupling member 28 and converted into an oscillating reciprocating motion about the rotation axis of the output shaft 20. FIG. 2 shows the coupling/connecting element 22 in a detail view. The oscillating reciprocating motion is in an angular range of between 0.4 and 2.5°, particularly between 0.8 and 1.6°, but preferably between 1 and 1.4°. Up to 30000 reciprocating motions are executed per second, but particularly 25000 reciprocating motions per second, but preferably up to 20000 reciprocating motions per second.

As can be seen from FIG. 1, the motor shaft 18, at its front side that faces toward the tool, is rotatably accommodated in a first bearing 32 and, on its side that faces away from the tool, is rotatably accommodated in a second bearing 33. The first bearing 32 is disposed on the side that faces toward the tool, adjacent to the coupling member 28. The output shaft 20, at its front side that faces toward the tool, is rotatably accommodated in a third bearing 34 and, on its side that faces away from the tool, is rotatably accommodated in a fourth bearing 35. The second bearing is disposed on the side that faces toward the tool, adjacent to the connecting member 24. The two bearings 32, 34 are connected to each other via a bearing plate 36. The bearing plate 36 in this case is realized as a separate component in respect of the first housing part 14. The bearing plate 36 is made of a metal material or composite material, enabling the strength to the increased.

The four bearings 32, 33, 34, 35 may be realized as fixed or loose bearings.

A switching element 38 is provided for switching on the hand power tool 10. In the exemplary embodiment, the switching element 38 is realized as a switching slide. Upon actuation of the switching slide, an internal switch 40 is actuated, which switches on an electronics system 42. The electronics system 42 applies electric current to the electronically commutated electric motor 16, and/or controls it by closed-loop and/or open-loop control. The switch 40 and the electronics system 42 are accommodated by the second housing part 23.

Since, in the case of hand power tools 10 having electronically commutated electric motors 16, the electronics system 42 is more powerful and of a greater size and volume than in the case of brush motors, cooling is ever more important, and results in the need for optimum cooling. The cooling may be of a passive or active design. In the case of passive cooling, the thermal energy is removed by convection. In the case of active cooling, the thermal energy of the components to be cooled is removed by means of a cooling system.

In the exemplary embodiment, the cooling system is a fan 44. The fan 44 is mounted on the motor shaft 18, and disposed between the electronically commutated electric motor 16 and the eccentric element 26. It is also conceivable, however, for the fan 44 not to be mounted on the motor shaft 18, but to be connected to the motor shaft 18 via elements such as belts or gear wheels. It is equally conceivable for other cooling systems to be used, such as Peltier elements, heat sinks, additional actuators having air guide elements, or the like.

Figure 3:
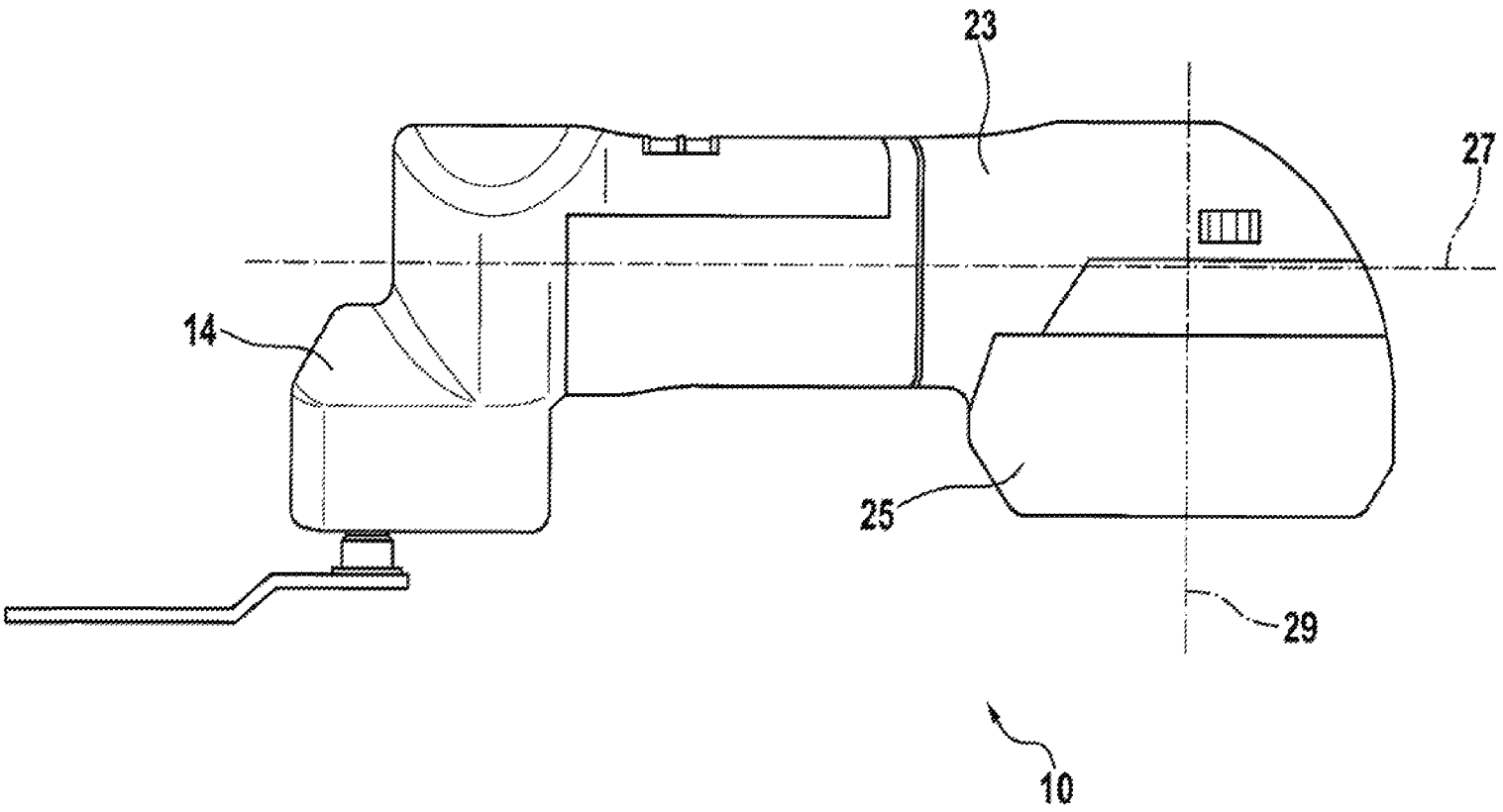
FIG. 3 shows a second embodiment of the hand power tool according to the disclosure, in a schematic representation.

In the exemplary embodiment in FIGS. 1 and 3, the hand power tool 10 is realized as a battery-operated hand power tool 10. As can be seen in FIG. 1, the rechargeable battery 25 is disposed, at least partially, on the second housing part 23 of the hand power tool 10. In this case, a greater part of a battery length $\mathbf{1}_B$ is integrated into the second housing part 23. The direction of insertion of the rechargeable battery 25 in this case is coaxial with the second axis 27.

As can be seen in FIG. 3, the rechargeable battery 25 is connected, at least partially, to the second housing part 23 of the hand power tool 10. In this case, a greater part of a battery length $\mathbf{1}_B$ is disposed outside of the second housing part 23. In this case, a battery axis 29 of the rechargeable battery 25, which goes through the rechargeable battery 25, is at an angle in relation to the second axis 27, in particular at right angles.

The battery voltage is in a range of between 3.6 and 36 V, in particular between 7.2 and 18 V. Preferably, however, the battery voltage is 10.8 V. The battery voltage values do not take account of possible battery voltage fluctuations.

The rechargeable battery 25 is composed, in particular, of lithium-ion battery cells. The rechargeable battery 25 in this case comprises one or more rows of battery cells, which, in turn, are connected in parallel to each other. Lithium-ion batteries are distinguished by a high energy density and by thermal stability, even in the case of high loads, which means a high power. Another major advantage is that there is little self-discharge, the result being that the batteries can also be used even in the case of relatively long downtimes.

Ensuing from these advantages are the advantages of the application according to the disclosure, in particular that the hand power tool 10, on the one hand, can be small and compact in its dimensions and, on the other hand, deliver high power outputs.

It is conceivable for a battery voltage indicator to be integrated in the handle region. The battery voltage indicator may be provided to provide an optical indication of the level of the battery voltage. This may be achieved by means of colored LEDs, flashing LEDs, digital indicator elements, LCDs and the like.

Figure 4:
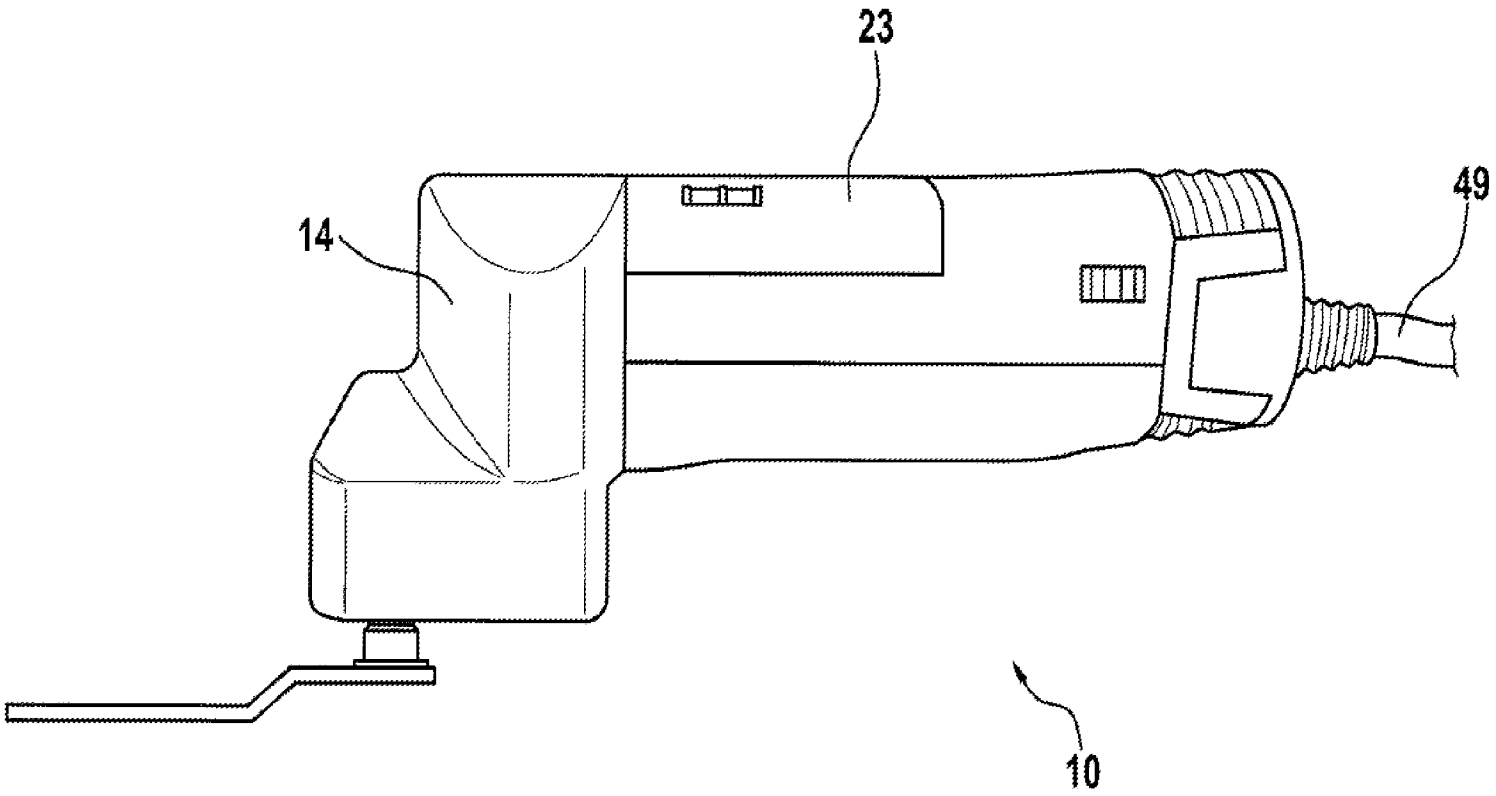
FIG. 4 shows a third embodiment of the hand power tool according to the disclosure, in a schematic representation.

FIG. 4 shows the hand power tool 10 according to the disclosure as a mains-power operated hand power tool 10. A mains-power cable 49, not represented in full, is attached to the second housing part 23 of the hand power tool 10. In the exemplary embodiment in FIG. 4, the mains-power cable serves as an energy source for the hand power tool 10.

Figure 5:
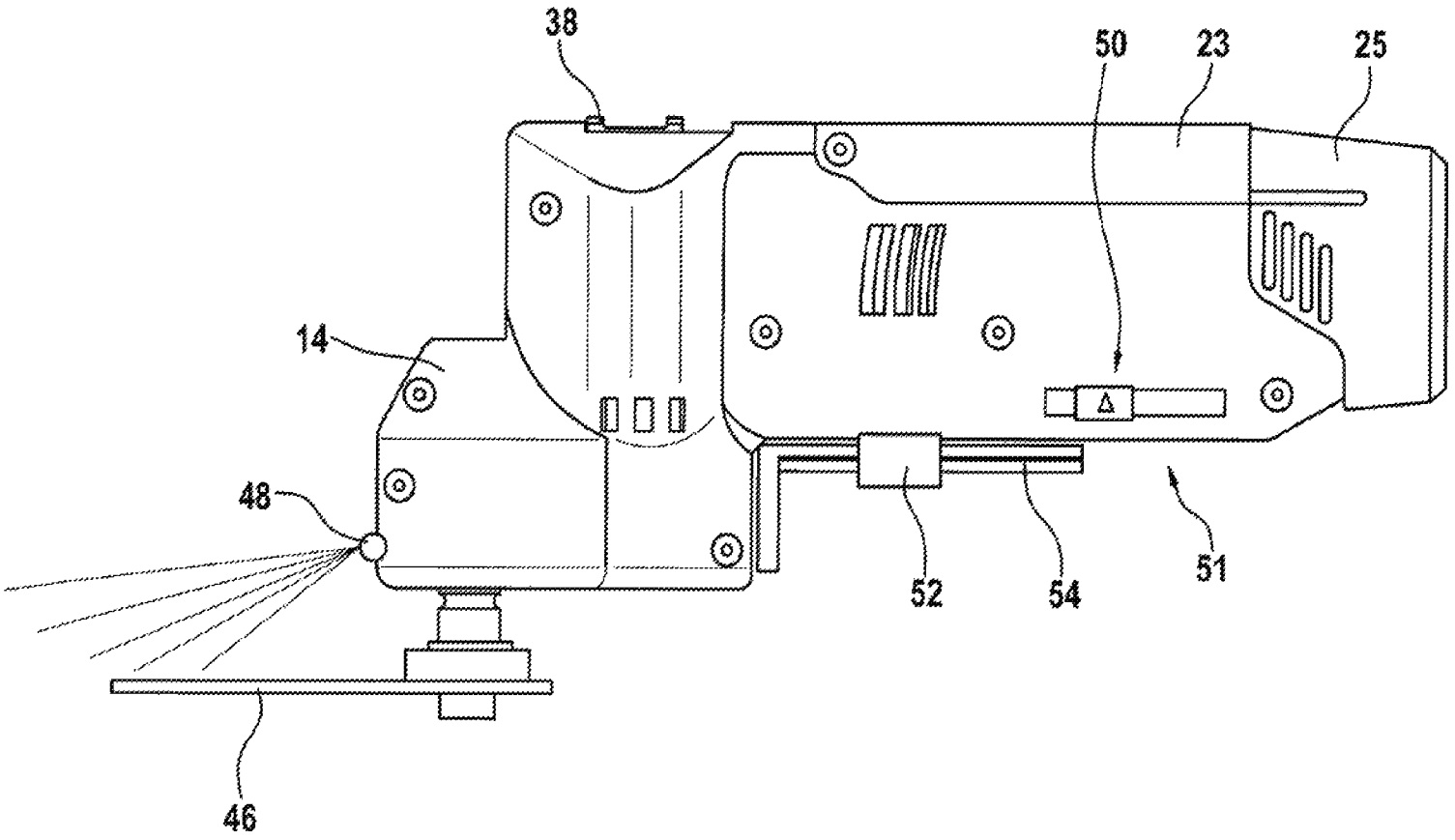
FIG. 5 shows a fourth embodiment of the hand power tool according to the disclosure, in a schematic representation.

FIG. 5 shows a further embodiment of the hand power tool 10 according to the disclosure, with a mounted working tool 46. A lighting device 48 is disposed on the outside face, on a side of the first housing part 14 that faces toward the working tool 46. The lighting device 48 may illuminate a working field, but may also project optical information on to the working tool 46. The lighting device 48 may have a single LED or, also, a plurality of LEDs. Alternatively, the lighting device 48 may also be realized as a projection device.

An adjusting device 50 is disposed on a lower side 51 of the second housing part 23. The adjusting device 50 is provided to adjust a rotational speed and/or an operating mode such as, for example, an energy-saving mode or a boost mode.

Figure 6:
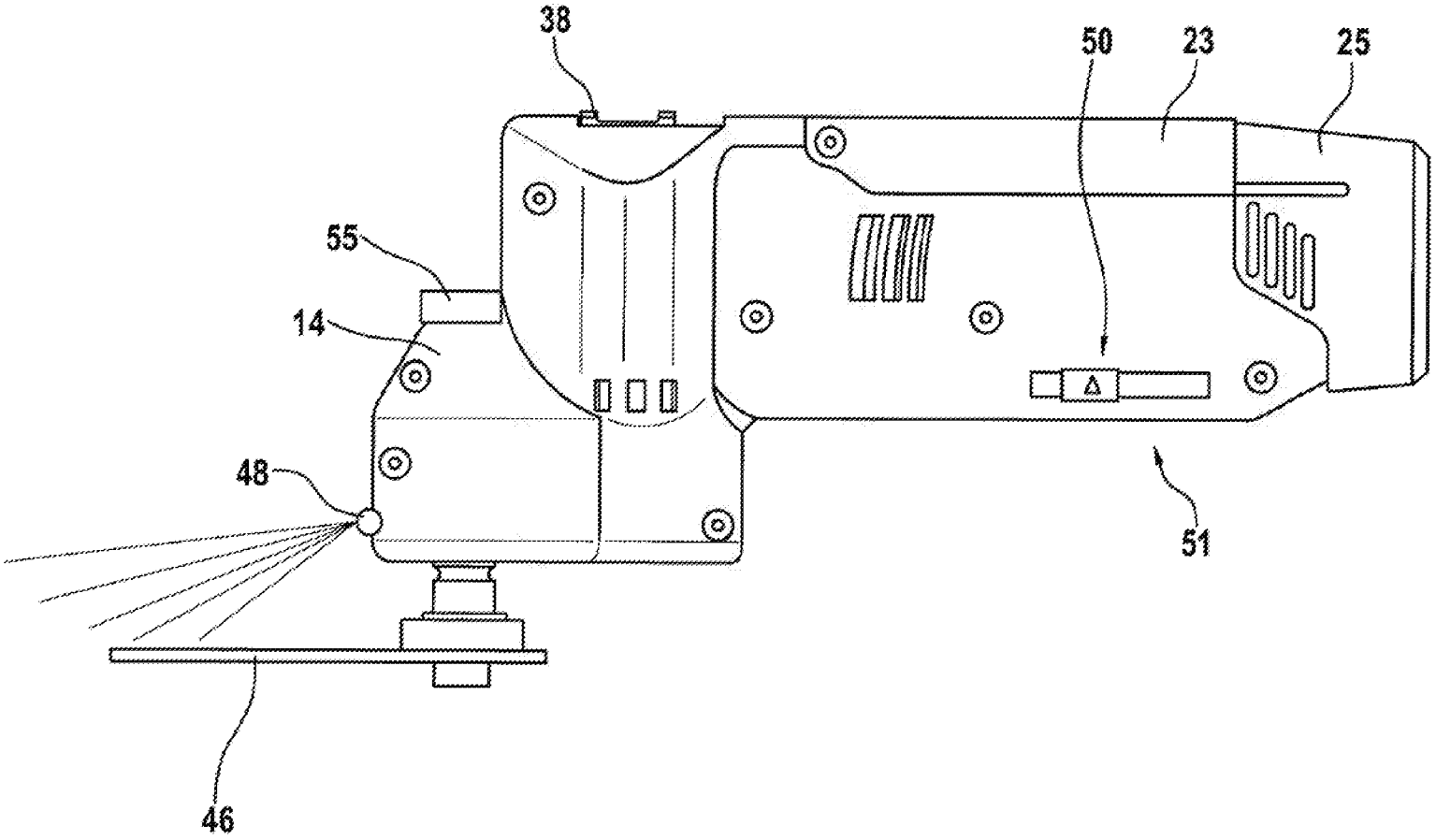
FIG. 6 shows a fifth embodiment of the hand power tool according to the disclosure, in a schematic representation.

A receiving element 52 is likewise disposed on the lower side 51 of the second housing part 23. The receiving element accommodates a tool 54 provided for changing the working tool 46. FIG. 6 shows an embodiment of the hand power tool 10 according to the disclosure having a pressure element 55 that is provided to enable the working tool 46 to be changed without the use of a tool.

What is claimed is:

1. A hand power tool, comprising:

at least one motor shaft with a first bearing and a second bearing mounted on the at least one motor shaft for rotation about a first common axis;

a rechargeable battery;

a first housing part formed as a one-piece, unitary body, wherein the at least one motor shaft and the first housing part define the first common axis;

at least one output shaft with a third bearing and a fourth bearing mounted on the at least one output shaft, the at least one output shaft having an end portion that protrudes externally from the first housing part and is configured to carry a tool to be driven in an oscillating manner by the at least one output shaft;

at least one electric-motor drive that acts directly upon the at least one motor shaft, that is accommodated entirely by the first housing part, and that includes an electronically commutated electric motor;

a second housing part configured to accommodate the rechargeable battery, wherein the rechargeable battery and the second housing part define a second common axis;

a coupling/connecting element connected at one end to the at least one motor shaft and connected at a second end to the at least one output shaft; and at least one bearing plate formed separately from and arranged within the first housing part, the at least one bearing plate connecting the first and third bearings, an integral portion of the first housing part connecting the second and fourth bearings, wherein the at least one bearing plate is formed as a one-piece, unitary body that is positioned closer to the end portion of the at least one output shaft than the integral portion of the first housing part and arranged adjacent to the coupling/connecting element.

2. The hand power tool according to claim 1, wherein the first common axis is at an angle of 90° in relation to the second common axis.

3. The hand power tool according to claim 1, wherein the at least one motor shaft and the at least one output shaft are arranged so as to be parallel with each other.

4. The hand power tool according to claim 1, wherein the electronically commutated electric motor has a diameter that is greater than or equal to 25 mm, and less than or equal to 60 mm.

5. The hand power tool according to claim 1, wherein the at least one bearing plate is arranged within a receiving region of the first housing part, the receiving region having a planar floor and at least one wall extending perpendicularly from the planar floor.

6. The hand power tool according to claim 5, wherein the planar floor vertically supports a planar surface of the at least one bearing plate via direct contact, the planar surface extending across an entire extent of the at least one bearing plate.

7. The hand power tool according to claim 6, wherein the at least one bearing plate is nested within the receiving region of the first housing part such that a laterally inwardly facing surface of the at least one wall directly contacts a laterally outwardly facing surface of the at least one bearing plate so as to laterally secure the at least one bearing plate in the receiving region, the laterally inwardly facing surface and the laterally outwardly facing surface oriented parallel to each other one another.

8. The hand power tool according to claim 1, wherein the hand power tool is a battery-operated hand power tool.

9. The hand power tool according to claim 1, wherein the coupling/connecting element has a first side that extends across an entire extent of the coupling/connecting element in a direction perpendicular to the first common axis and faces the at least one bearing plate, the first side lying entirely in a first plane oriented normal to the first common axis.

10. The hand power tool according to claim 9, wherein the at least one bearing plate has a second side that extends across an entire extent of the at least one bearing plate and faces the coupling/connecting element, the second side lying entirely in a second plane oriented normal to the first common axis.

11. The hand power tool according to claim 10, wherein the at least one bearing plate has a third side that is disposed opposite to the second side and extends across the entire extent of the at least one bearing plate, the third side lying entirely in a third plane oriented normal to the first common axis.

12. The hand power tool according to claim 11, wherein the third side of the at least one bearing plate abuts a housing surface of the first housing part, the housing surface lying entirely in a fourth plane oriented normal to the first common axis.

13. The hand power tool according to claim 9, wherein the at least one bearing plate has a second side that extends across an entire extent of the at least one bearing plate and faces a housing surface of the first housing part, the second side and the housing surface lying entirely in a second plane oriented normal to the first common axis.

* * * * *